United States Patent [19]

Miller

[11] 4,079,910

[45] Mar. 21, 1978

[54] CONCRETE FORM SYSTEM INCLUDING HOLDING AND SPACING APPARATUS

[76] Inventor: Maurice M. Miller, 3311 NE. 65th, Seattle, Wash. 98115

[21] Appl. No.: 755,820

[22] Filed: Dec. 30, 1976

[51] Int. Cl.[2] ..... E04G 17/08

[52] U.S. Cl. ..... 249/44; 249/46; 249/216; 249/219 W

[58] Field of Search ..... 249/40–46, 249/190–191, 210, 213–218, 219 W

[56] References Cited

U.S. PATENT DOCUMENTS

| | | | |
|---|---|---|---|
| 1,144,778 | 6/1915 | Parisho | 249/213 |
| 1,850,402 | 3/1932 | Lampert | 249/42 |
| 3,198,476 | 8/1965 | Smith | 249/42 |
| 3,415,484 | 12/1968 | Klaiss | 249/42 |

*Primary Examiner*—Francis S. Husar
*Assistant Examiner*—John McQuade
*Attorney, Agent, or Firm*—Seed, Berry, Vernon & Baynham

[57] ABSTRACT

A concrete form holding and spacing apparatus is provided for opposed banks of form sheathing panels having backing studs, and includes reglet runners bearing against the runner faces of the panel backs and held apart by spacer rods which detachably interlock with at least one of the respective runners. Clamping means detachably connect to the runners and extend through seams or openings in the panel banks and between pairs of the backing studs to receive clamping cams or wedges.

14 Claims, 9 Drawing Figures

20
22
24
26
30
32
34
35
36
38
38a
38b
40
42
44
45
46
48
48b
50
52
53
55
56
58
60

FIG. 4
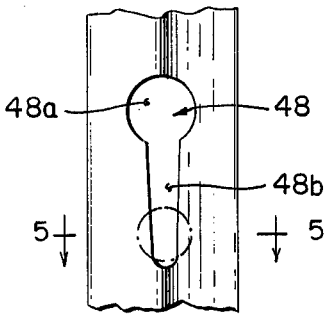
FIG. 5
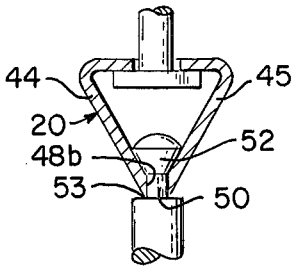
FIG. 6
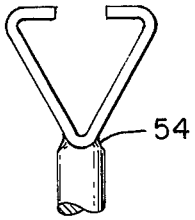
FIG. 7
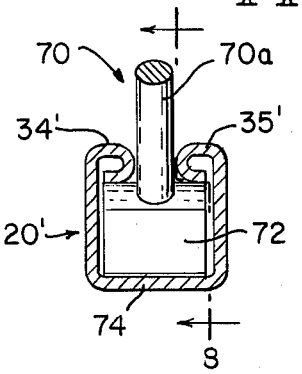
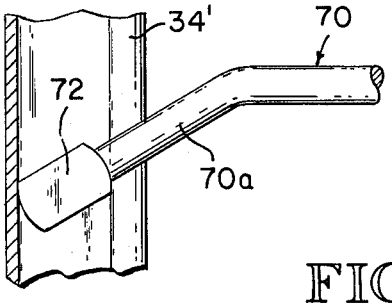
FIG. 8
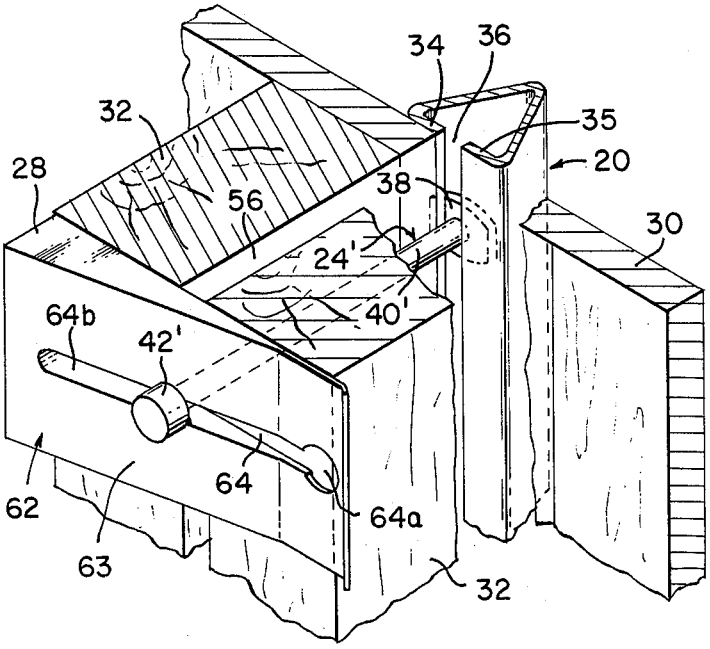
FIG. 9

CONCRETE FORM SYSTEM INCLUDING HOLDING AND SPACING APPARATUS

BACKGROUND AND OBJECTS OF THE INVENTION

The present invention relates to form holding and spacing apparatus for holding opposed banks of form panels in spaced relation to receive concrete therebetween.

In concrete wall construction it is often desired to provide a smooth exposed concrete surface unbroken by random crack lines, tie rod ends, or the seam lines experienced at the butt joints of the plywood form sheets conventionally used in formwork. At the same time, form erection speed and economy are always important.

The present invention aims to provide an improved concrete form system providing crack control in the finished concrete wall and which eliminates butt joints between form panels and surface flaws caused by elements of the form system.

Another object is to provide a form system which can be speedily erected and easily stripped.

The invention further aims to provide a form system which is versatile and which provides a reglet for use as a wireway or for the attachment of various fastening devices or guides after the formwork is removed.

SUMMARY OF THE INVENTION

In carrying out these objectives there is provided opposed pairs of reglet runners which become a permanent exposed part of the concrete wall and cause the normal cracking to be confined to the cross-sectional area between opposed runners. The runners are cross-connected by spacer rods and detachably receive clamping devices each including a rod element which projects outwardly between juxtaposed form panels and receives cams or a wedge pressing against backing studs which in turn hold the panels against the runners. With this arrangement the form panels may be spaced apart at the joint seams rather than butting, and the runners cover the seam gap between panels.

BRIEF DESCRIPTION OF THE DRAWINGS

In the accompanying drawings:

FIG. 4 is a detail elevational view of a portion of the runners and with the location of a corresponding spacer rod shown in phantom;

FIG. 5 is a cross-sectional view taken as indicated by line 5—5 of FIG. 4, and with a spacer bar and clamping rod shown fragmentarily in operative position;

FIG. 6 is an end view of a runner showing a fixed connection with a spacer rod;

FIG. 7 is a cross-sectional view of a modified runner and showing the related end portion of a projecting support arm;

FIG. 8 is a fragmentary longitudinal vertical sectional view taken as indicated by the line 8—8 in FIG. 7; and FIG. 9 is a detail view corresponding to FIG. 3 and showing a modified clamping means.

DETAILED DESCRIPTION OF THE DRAWINGS

Figures 1, 2, 3:
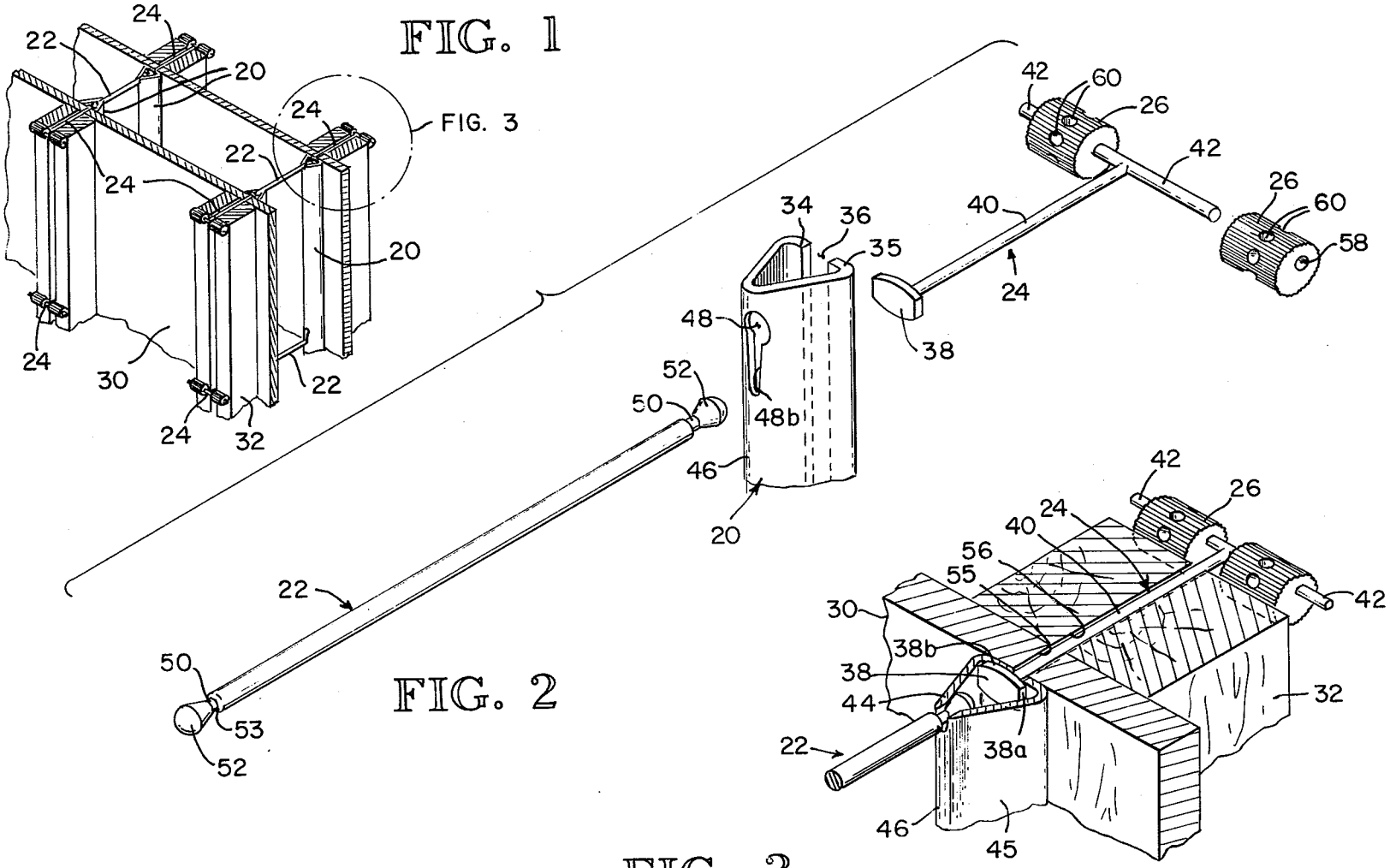
FIG. 1 is a perspective horizontal sectional view showing part of a concrete form, system erected with the form holding and spacing apparatus of the present invention.
FIG. 2 is an exploded view illustrating various elements of the system.
FIG. 3 is a fragmentary detailed view taken as indicated by the phantom circle in FIG. 1.

Referring to the drawings, it is seen that the form holding and spacing apparatus of the present invention includes runners 20, spacer rods 22, and clamping means which may comprise T-rods 24 provided with suitable clamping cams 26. The system is utilized in conjunction with form sheathing panels 30, which may be plywood, and pairs of backing studs 32.

Generally speaking the runners 20 are reglets in that they have opposed inturned longitudinal lips 34, 35 at the outward side spaced by a longitudinal slot 36 for retaining an enlarged head 38 at the inward free end of the central leg 40 of the T-rod 24. This head 38 has a generally rectangular shape with its smaller side **38*a* narrower than the slot 36 for entry into the runner and its larger side 38*b* parallel to the cross-arms 42 of the T-rod 24 and wider than the slot so that the head 38** cannot be pulled out of the runner when the cross-arms of the T-rod are turned to a position transverse relative to the longitudinal axis of the runners.

The runners 20 may have a generally triangular cross-section provided by the lips 34, 35 as the outward side and a dihedral at the inward side formed by side walls 44, 45 meeting at an apex 46. At this apex it is preferred to provide a row of regularly spaced keyhole slots 48 in at least one of each opposed pair of runners. To mate with these keyhole slots the spacer rods are necked at 50 to provide a retaining head 52 and opposing annular shoulder 53, best shown in FIG. 5. The head 52 is small enough to enter the eye **48*a* of the keyhole slot and it and the shoulder 53 are larger than the narrow part 48*b* of the keyhole slot so that the spacer rod will be restrained against endwise movement relative to the runner when the head 52 is interlocked with the side edge portions of the narrow part 48*b*. It will be noted that the head 52 is preferably tapered outwardly from the neck 50 to match the dihedral angle between the side walls 44, 45 of the runners. The other end of the spacer rods can be welded to the respective runner as indicated by welding bead 54 in FIG. 6**, or can also have the aforedescribed interlock.

Directing attention to FIGS. 1 and 3, it will be noted that when the form system is assembled, pairs of juxtaposed form panels 30 are spaced apart by a narrow seam gap 55 centered relative to the entry slot 36 of a respective runner 20, and the inward face portions of the panels 30 adjoining the seam gap 55 bear against the outward faces of the lips 34, 35. The result is that the runner covers the inward side of the seam gap 55 while leaving the latter exposed to the inside of the runner 20 that the head 38 of the T-rod 24 can occupy the runner and the leg 40 of the T-rod can project outwardly through the seam gap 55 and a registering gap 56 between the pairs of the backing studs 32 holding the form panels 30 against the lips 34, 35 of the respective runner. The backing studs 32 are in turn clamped in position by pairs of the clamping cams 26, each of which has a longitudinally toothed cylindrical body with an eccentrically located, longitudinal through bore 58 whereby the cam can be journaled on a respective arm 42 of the T-bar 24. The body of the clamping cam also has a circumferential row of radial bores 60 for receiving the shank of a nail or the like for manually turning the cam on the arm 58 to bring the wider portion of the cam to bear against the related stud 32.

As indicated in FIG. 9, as an alternative to a pair of the clamping cams 26, a wedge 62 with a tapered outer face 63 and a longitudinal keyhole slot 64 can be utilized, in which case a modified rod 24' is used having a cylindrical outer head 42' in place of the arms 42. The eye 64*a* of the keyhole slot 64 adjoins the tapered end of the wedge 62 so that after the eye is placed over the head 42', and the wedge is driven to the right as viewed in FIG. 9, the shank 40' of the rod 24' will ride in the narrow part 64*b* of the slot with the rod head 42' bearing against the tapered outer face 63 of the wedge. As a result the wedge forces the pair of studs inwardly against the related form panels 30.

A modified runner 20' of generally rectangular, rather than triangular cross-section, and with double back lips 34', 35', is shown in FIG. 7. This modified runner can be provided with a keyhole slot for reception of a spacer rod 22 in the same manner as the runner 20.

For purposes of example, the runner 20' has been illustrated in FIGS. 7–8 in conjunction with a projecting detachable support arm 70 for use as a scaffold guide or the like after the concrete wall has been poured and the forms removed. The arm 70 has an enlarged head 72 which is thin enough in side view to pass through the slot between the lips 34', 35' when the head is turned a quarter turn from the position shown in FIGS. 7–8. In plan view the head 72 is substantially as wide as the cavity of the runner 20' and has a length greater than the front to back dimension of the cavity so that when the head occupies the cavity it will wedge in a sloped position between the lips 34', 35' and the opposing wall 74 as illustrated in FIG. 8. The arm 70 may have a sloped portion 70*a* adjoining the head 72 so that the remainder of the arm will be horizontal when the arm is in operative position.

It will be appreciated that whalers can be used in the conventional manner in conjunction with the backing studs 32. In such an instance T-rods 24 would be modified so that their legs 40 are elongated by the thickness of the whalers and so that the head 38 is oriented a quarter turn from the FIG. 2 form. So modified the clamping cams 26 can bear against the outward base of the whalers and thereby clamp the whalers against the backing studs.

In the on-site assembly of the described form scaffold system, normally one of the form walls will be erected with the reglet runners 20 in place secured against the form panels by the selected clamping means; i.e., the T-rods 24 and clamping cams 26 or the rods 24' and wedges 62. Then, if reinforcing steel is required for the concrete wall to be poured, a reinforcing steel skeleton is formed and placed in approximately proper position. Next, the spacer rods 22 and the runners for the second formwork are moved into position with the spacer rods passing through the reinforcing steel skeleton and inserted in the keyhole slots 48 of the runners of the already erected form wall. The reinforcing steel can then be tied to the spacer rods to secure the proper form clearance for the reinforcing steel. Following this the second form wall is erected against the respective runners by use of the selected clamping means.

It will frequently be necessary to provide runners midway between the side edges of the panels as well as at the seams between panels. In these instances holes are bored in the panels for passage of the heads 38 of the clamping devices. Like the seam gaps 55, these holes will be covered by the respective runners.

The embodiments of the invention in which a particular property or privilege is claimed are defined as follows:

1. A form system comprising:

two spaced upright banks of sheathing panels having outer faces and opposed inner faces, each bank being formed with a pattern of lateral openings extending outwardly from the inner face to the outer face thereof;

two sets of backing members bearing against the outer faces of respective said banks and leaving the outer ends of said lateral openings exposed;

two sets of reglet runners having inwardly facing sides and bearng by outwardly facing sides against the inner faces of respective said banks at locations covering the inner ends of said lateral openings;

a plurality of spaced transverse spacer rods connected at their ends with said sets of runners to hold the latter in predetermined spaced relationship; and a plurality of clamping means detachably connected to said runners, projecting outwardly through said lateral openings, and bearing against outer sides of said backing members to hold said banks of sheathing panels against respective said sets of runners.

2. A form system according to claim 15 in which each of said runners has its outwardly facing side formed by a pair of coplanar opposed lips separated by a longitudinal gap for registering with said lateral openings.

3. A form system according to claim 1 in which said runners are generally triangular in cross-section and present a dihedral angle at their inwardly facing side.

4. A form system according to claim 3 in which one of said runners has a plurality of keyhole slots spaced along the apex of the dihedral angle at its inwardly facing side, and said spacer rods have enlarged heads fitting into said keyhole slots.

5. A form system according to claim 2 in which each of said clamping means has an enlarged head at its inward end adapted to fit into said longitudinal gap of the respective runner when the fastening means is in an assembly position and to be retained by said lips when turned a quarter turn from the assembly position to a locked position.

6. A form system according to claim 1 in which each of said spacer rods is interlocked at one end with one of said runners by an interlock holding the spacer rod against endwise movement relative to such runner, but permitting assembly at a form erection site.

7. Form holding and spacing apparatus for holding a bank of juxtaposed form sheathing panels in predetermined spaced relation to another bank of juxtaposed form sheathing panels comprising:

a pair of oppositely facing, parallel spaced reglet runners having their outwardly facing sides adapted to bear against respective ones of said banks at locations whereat the banks present openings;

a plurality of transverse spacer rods connected at their ends to the inwardly facing sides of said runners at spaced intervals along the length of the runners; and a plurality of outwardly extending clamping means detachably connected to said runners at spaced intervals along the length of the runners for extending from the runners outwardly through said openings for detachably holding such banks against said runners by backing members, the runners covering said openings.

8. Apparatus according to claim 7 in which each of said runners has its outwardly facing side formed by a pair of coplanar opposed lips separated by a longitudinal gap for registering with a said opening in a bank of panels and receiving said clamping means.

9. Apparatus according to claim 7 in which said runners are generally triangular in cross section and present a dihedral angle at their inwardly facing side, each of said runners having a plurality of keyhole slots spaced along the apex of the dihedral angle at its inwardly facing side, and said spacer rods having enlarged heads fitting into said keyhole slots.

10. Apparatus according to claim 8 in which each of said clamping means has an enlarged head at its inward end adapted to fit into said longitudinal gap of the respective runner when the fastening means is in an assembly position and to be retained by said lips when turned a quarter turn from the assembly position to a locked position.

11. Apparatus according to claim 10 in which each of said clamping means has a cross-rod at its outward end, and cam means journaled on the crossrod for wedging the backing members against the form sheathing panels to hold them against said runners.

12. Apparatus according to claim 10 in which each of said clamping means extends outwardly from said enlarged head at its inward end and detachably interfits adjacent its outward end with a wedge for wedging the backing members against the form sheathing panels to hold them against said runners.

13. Apparatus according to claim 8 in which said spacer rods are interlocked at their ends with said runners by an interlock holding the spacer rods against endwise movement relative to the runners, but permitting assembly at a form erection site.

14. Form spacing apparatus comprising:

a pair of oppositely facing spaced reglet runners having outwardly facing sides occupying parallel planes for bearing against the opposed sides of two opposed banks of forms and having inwardly facing sides formed with a plurality of keyhole slots therealong, the outwardly facing side of each runner being formed by a pair of opposed lips separated by a longitudinal gap for receiving a clamping device; and an elongated spacer extending between said runners and detachably interfitting at each of its ends with one of the keyhole slots of the respective runner for holding the runners against relative movement lengthwise of the spacer.

* * * * *